US006860055B1

(12) United States Patent
Walrath

(10) Patent No.: US 6,860,055 B1
(45) Date of Patent: Mar. 1, 2005

(54) ADJUSTABLE RIFLE SUPPORT

(75) Inventor: Alden B. Walrath, Plantation, FL (US)

(73) Assignee: Ligi Tool and Engineering, Inc., Deerfield Beach, FL (US)

( * ) Notice: Subject to any disclaimer, the term of this patent is extended or adjusted under 35 U.S.C. 154(b) by 0 days.

(21) Appl. No.: 10/925,677

(22) Filed: Aug. 26, 2004

(51) Int. Cl.[7] ..... F41A 23/60; F41A 23/16
(52) U.S. Cl. ..... 42/94; 211/64
(58) Field of Search ..... 42/94; 211/64; 89/37.04

(56) References Cited

U.S. PATENT DOCUMENTS

| | | | | | |
|---|---|---|---|---|---|
| 499,315 | A | * | 6/1893 | Borchardt | 89/132 |
| 882,988 | A | * | 3/1908 | Aloyos et al. | 89/41.01 |
| 1,042,357 | A | * | 10/1912 | Livtschak | 89/37.04 |
| 3,711,984 | A | * | 1/1973 | Dyer et al. | 42/94 |
| 4,696,461 | A | * | 9/1987 | Zelinski | 269/16 |
| 4,702,029 | A | * | 10/1987 | DeVaul et al. | 42/94 |
| 4,972,619 | A | * | 11/1990 | Eckert | 42/94 |
| 5,081,783 | A | * | 1/1992 | Jarvis | 42/94 |
| 5,173,563 | A | | 12/1992 | Gray | |
| 5,347,740 | A | | 9/1994 | Rather | |
| 5,419,233 | A | * | 5/1995 | Mulvaney | 89/37.04 |
| 5,497,575 | A | | 3/1996 | Fried | |
| 5,617,666 | A | * | 4/1997 | Scott | 42/94 |
| 5,845,427 | A | * | 12/1998 | Taylor | 42/94 |
| 5,930,933 | A | | 8/1999 | Schleicher | |
| 5,937,561 | A | * | 8/1999 | Abernethy | 42/94 |
| 6,305,117 | B1 | * | 10/2001 | Hales, Sr. | 42/94 |
| 6,338,218 | B1 | * | 1/2002 | Hegler | 42/94 |
| 6,526,687 | B1 | * | 3/2003 | Looney | 42/94 |
| 6,539,660 | B1 | * | 4/2003 | Yeargin | 42/94 |
| 6,574,899 | B1 | * | 6/2003 | Mostello | 42/94 |
| 2004/0020097 | A1 | * | 2/2004 | Deros | 42/94 |

* cited by examiner

*Primary Examiner*—Teri Pham Luu
*Assistant Examiner*—Bret Hayes
(74) *Attorney, Agent, or Firm*—Alvin S. Blum

(57) ABSTRACT

A portable support apparatus provides for fine vertical adjustment of a support element for the forward portion of a rifle with a motion control including a worm gear and a rack and pinion. Whatever elevation is selected by rotation of the control will be maintained without need to lock the position. A manual or electrical actuator may be provided. A height adjustable rest for the stock end of the rifle also be provided. The apparatus includes legs that may be removed and stored within the case containing the apparatus.

12 Claims, 8 Drawing Sheets

ADJUSTABLE RIFLE SUPPORT

This invention relates to firearms accessories, and more particularly to a rifle support with fine vertical adjustment.

BACKGROUND OF THE INVENTION

When target shooting and hunting the accuracy of the rifle sights is critical. When adjusting and using the sights, the position in which the rifle is held when firing with the sights is also critical. Prior art rifle supports have not provided precise and stable vertical adjustment.

SUMMARY OF THE INVENTION

It is accordingly an object of the invention to provide a rifle support apparatus with precise vertical adjustment that is conveniently at hand and stable. It is another object that the apparatus be compact for transport and be easily set up. The apparatus of the invention includes a folding stand that lies flat within a recess in a case for transport. The stand has three panels. A first panel is hingedly attached at a first end to the case, and hingedly attached to a first end of a second panel at a second end. The second panel is hingedly attached at its second end to a third panel. The third panel is slidably mounted within the case recess for translatory motion toward and away from the first end of the first panel. When the third panel slides toward the first end of the first panel, the joint between the first and second panels rises vertically from the recess in the case. A rifle rest for the forward end of the rifle is mounted at that joint. The precise control of the translatory motion of the third panel is provided by a rack and pinion mechanism through a worm gear controlled by a hand wheel. By operating the vertical adjustment through a worm gear, the sliding position is stable without need to lock the position. For coarse adjustment of the translatory motion of the third panel, the rack and pinion mechanism is readily disengaged. This facilitates set-up and lowering of the rifle rest to lie flat within the case recess after use. A height-adjustable rest for the rifle stock is provided for use with the rifle rest. It may be storable within the case for transport and storage. These and other objects, features, and advantages of the invention will become more apparent when the detailed description is studied in conjunction with the drawings in which like elements are designated by like reference characters in the various drawing figures.

DETAILED DESCRIPTION OF PREFERRED EMBODIMENTS

Figure 1:
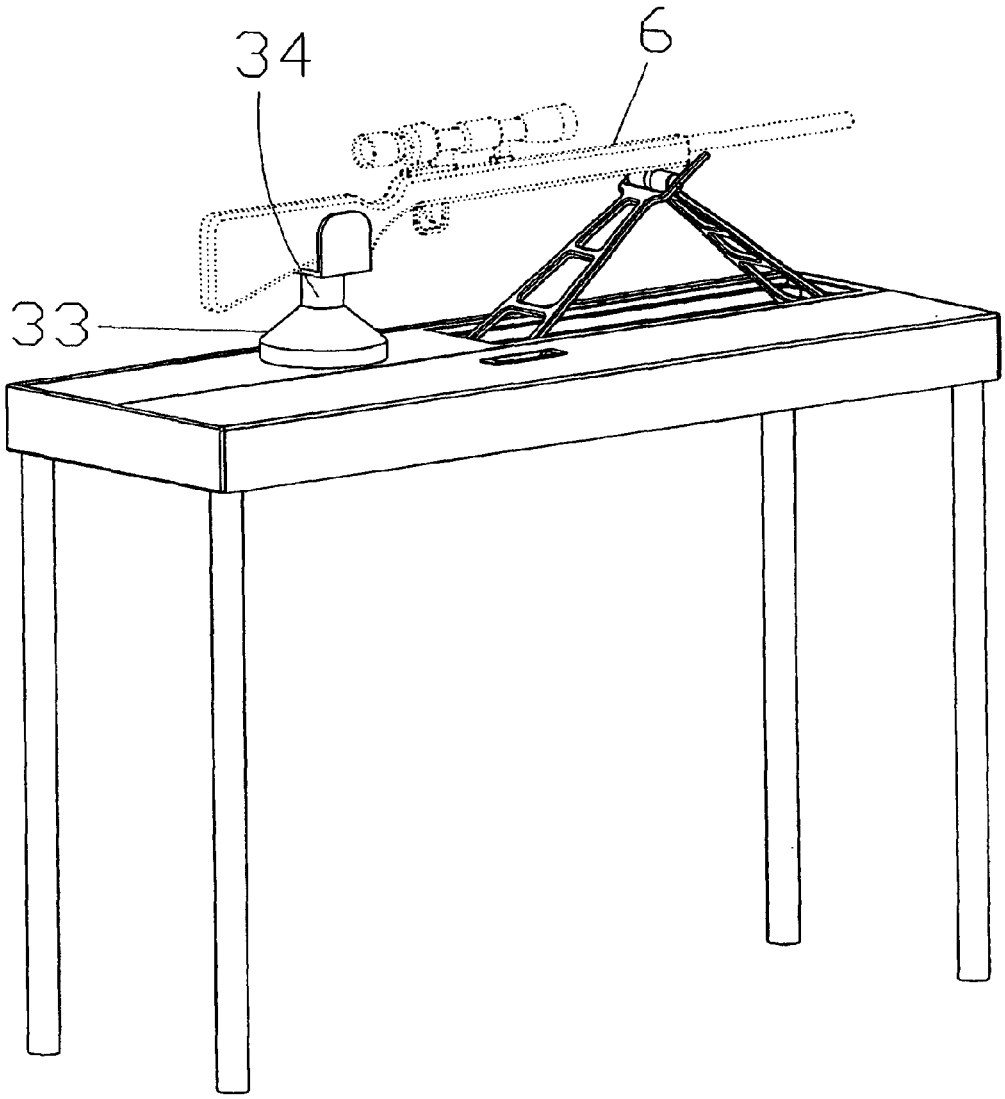
FIG. 1 is a perspective side view of the invention with rifle in place.
Figure 2:
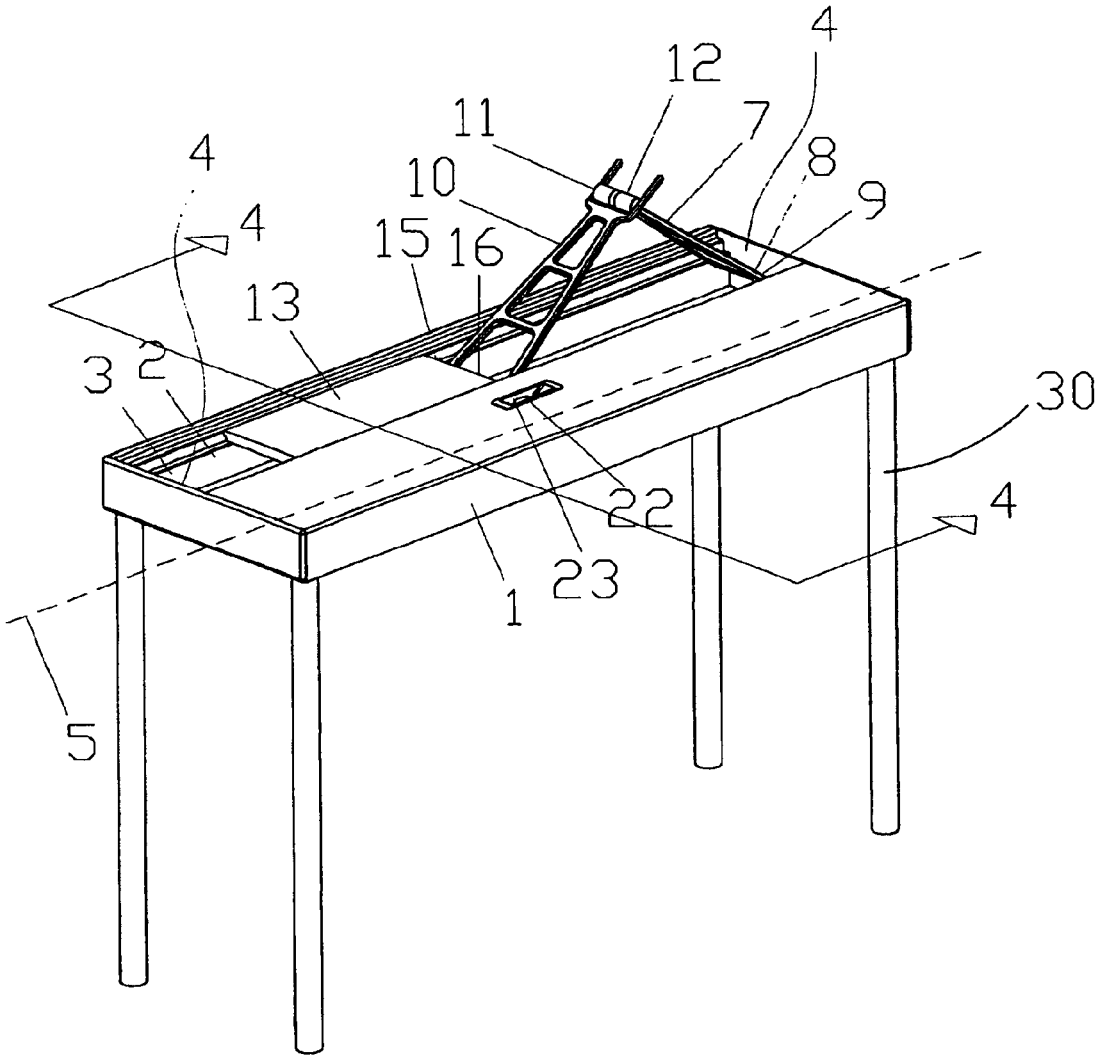
FIG. 2 is a perspective side view of the invention with cover removed.
Figure 3:
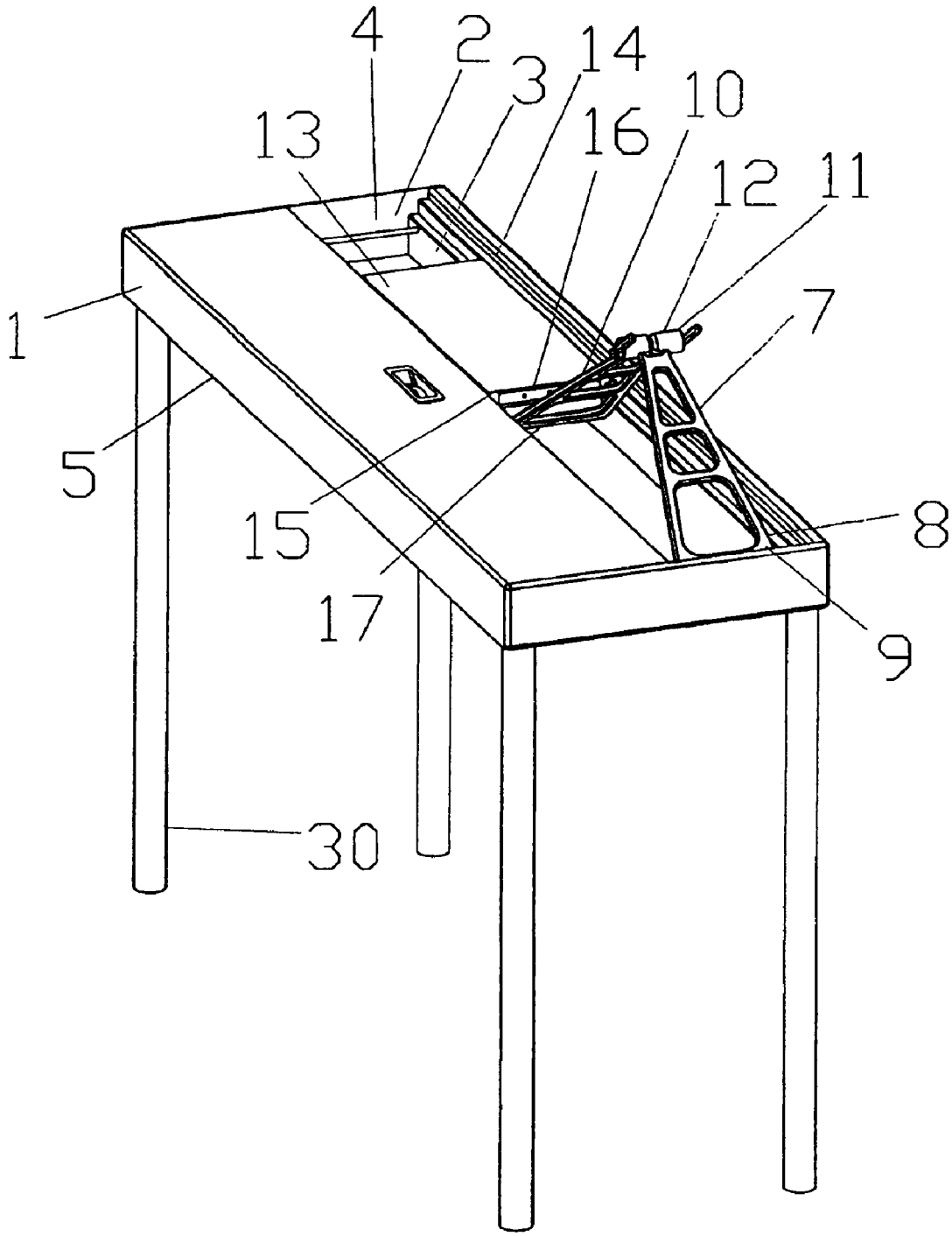
FIG. 3 is perspective end view of the invention with cover removed.
Figure 4:
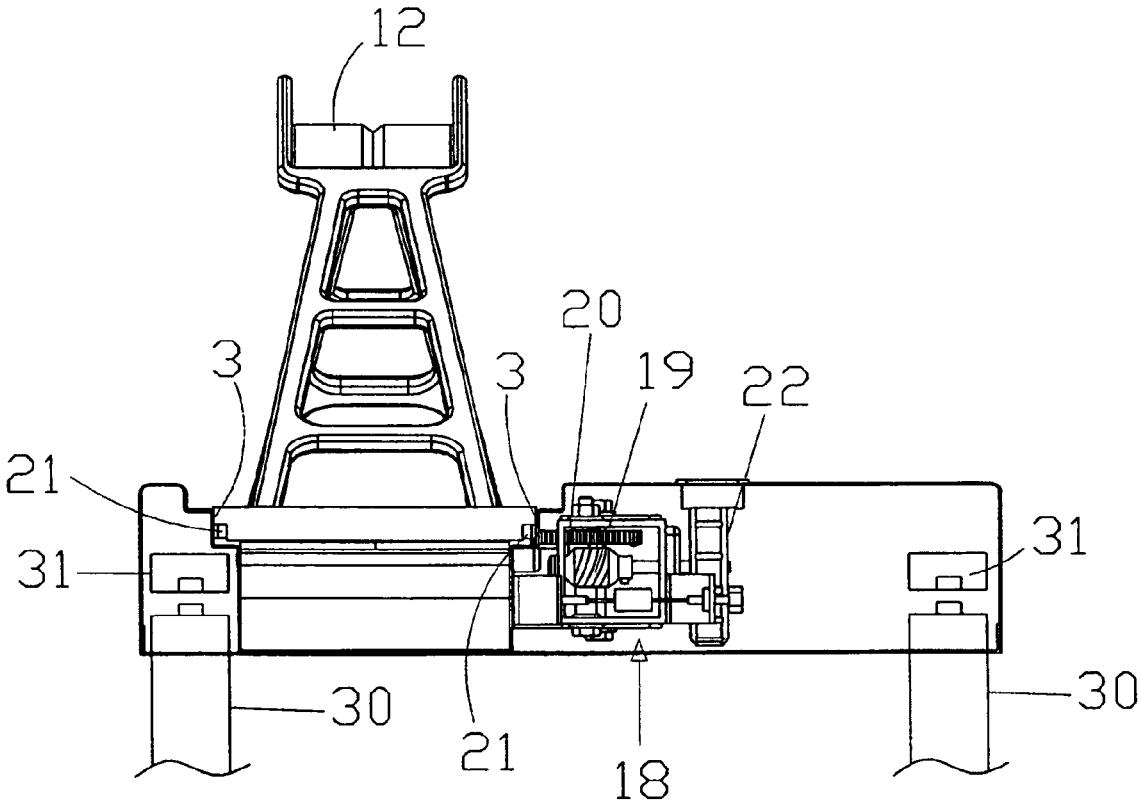
FIG. 4 is a section view through line 4—4 of FIG. 2.
Figure 5:
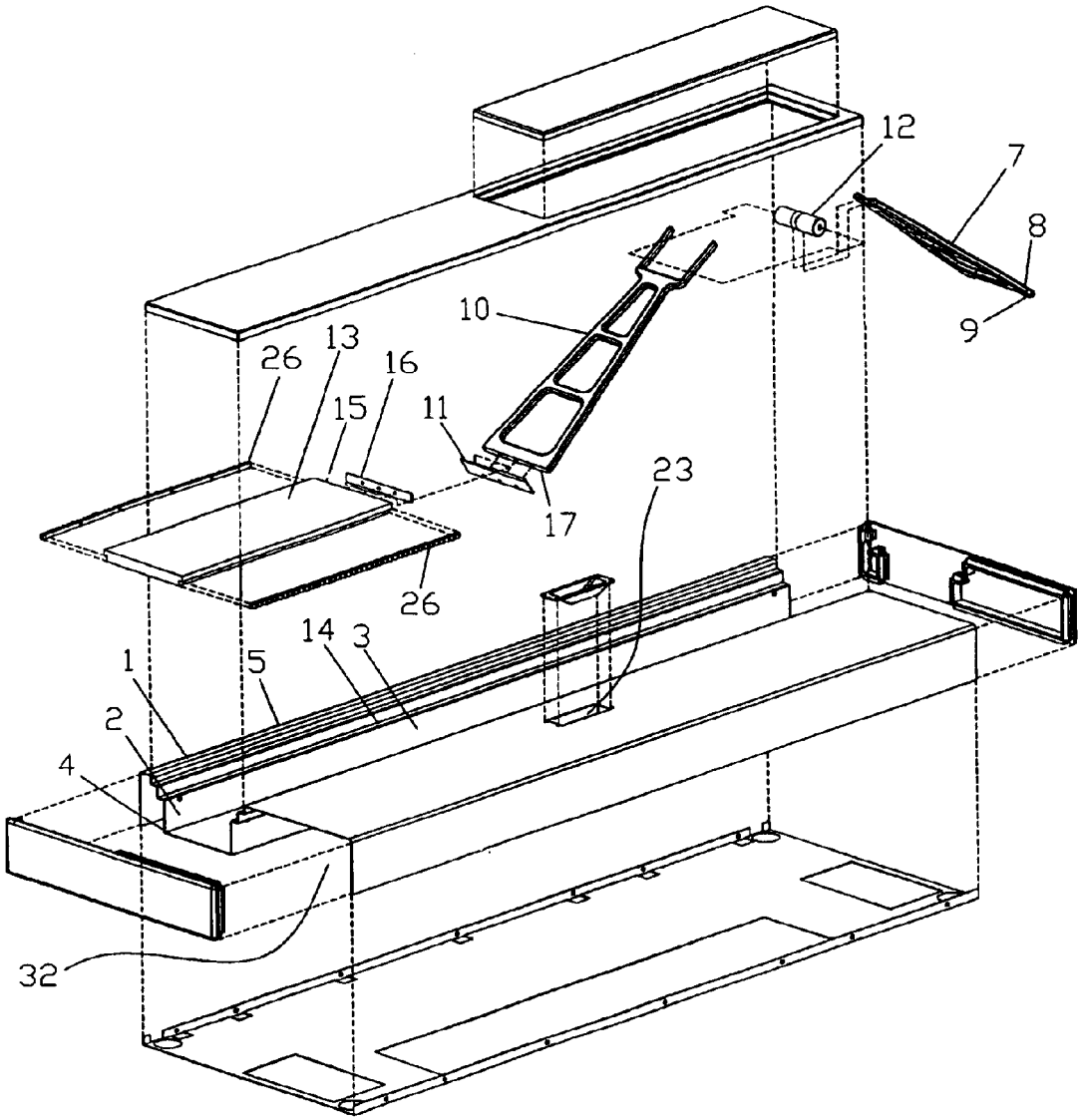
FIG. 5 is an exploded view of a portion of the structure of the invention.
Figure 6:
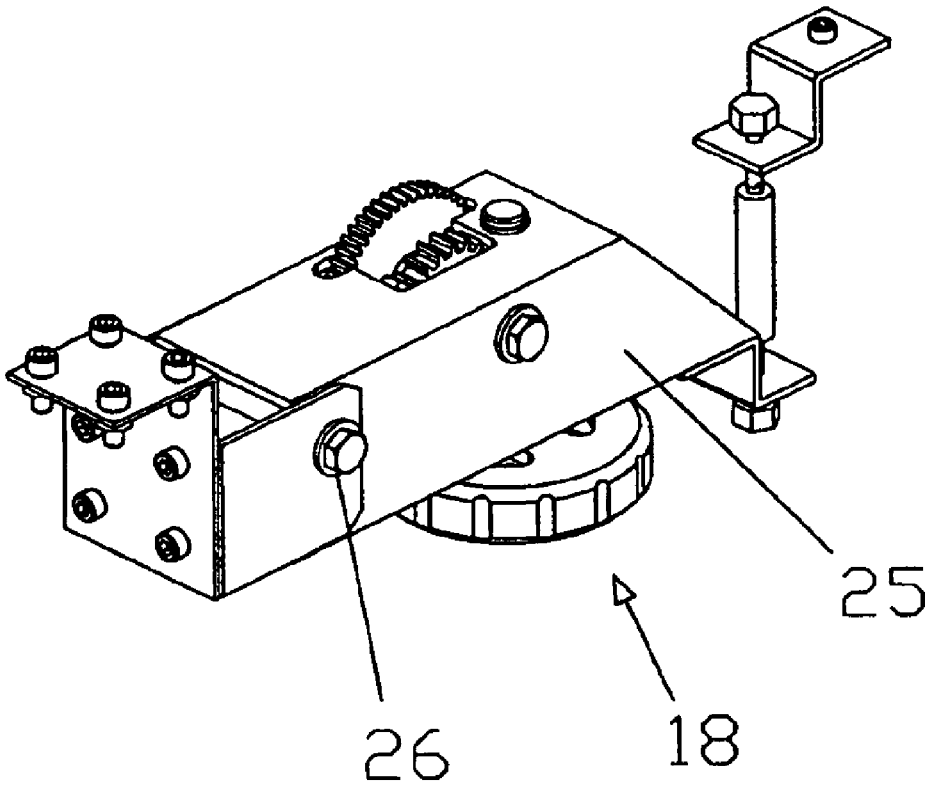
FIG. 6 is a perspective view of the motion control means.
Figure 7:
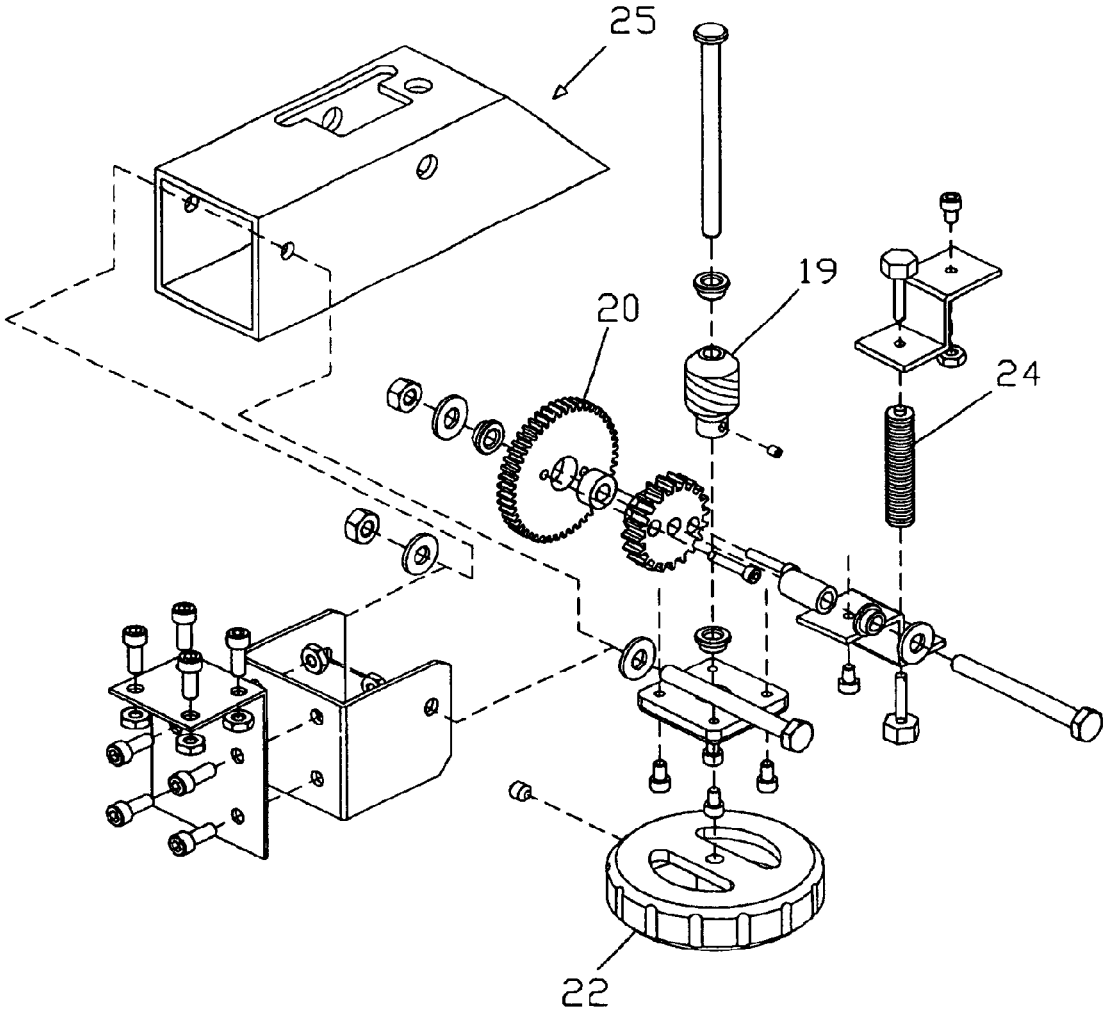
FIG. 7 is an exploded view of the motion control means.

Referring now to the drawing FIGS. 1–7, the adjustable support of the invention includes a case 1 with a long axis

5 supported on legs 30 that fit into sockets 31. The legs may be removed and fit into leg storage recess 32 in the underside of the case for transport and storage. A rectangular recess 22 in the upper surface of the case has long sides 3 and short sides 4. A first panel 7 has a first end 8 hingedly attached to a short end of the recess. A second panel 10 has a first end with a hinge 11 connected to a second end of panel 7. A third panel 13 lies flat and slides in slide mount 14 in the recess. It has a first end 15 hingedly connected at hinge 16 to the second end 17 of the second panel 10. A pair of elongate racks 21 are inset in the long sides of the third panel 13. A motion control means 18 includes a pinion gear 20 that engages one of the racks to provide precise rectilinear movement of the panel 13. As it advances toward the first panel, it forces panels 7 and 10 to fold, thereby slowly elevating the rifle rest 12 that is on the second panel. A removable cover 35 covers the panel 13. A hand wheel 22 extends upward through a slot 23 in the case so as to be readily accessible to the operator. Turning the hand wheel 22 rotates a worm gear 19 that turns the pinion gear 20. That imparts rectilinear motion to the panel 13, to raise or lower the rifle rest 12. Because of the nature of the worm gear in the gear train, the rest 12 will remain in its set position without the need for any fixing of the position. The motion control means 18 is mounted in a housing 15 pivoted at 26 so as to swing into contact with the rack or away from it. A spring 24 forces the pinion gear into contact with the rack. The operator may move the hand wheel laterally to disengage the rack to rapidly move the rest up or down. The worm gear train may then be used for fine adjustment when sighting the rifle. An accessory rifle stock rest 33 may also be stored within the case and used with the rest 12. It may be provided with a plurality of vertical elements 34 of various lengths so that the height may be adjusted by replacing one element with another of a different length. By providing a rack on each side of panel 13, the three panels may be reversed in the recess 2, so that the device may be more comfortably used by a left handed operator. The hinge or pivot connection of panel 7 must also be reversed.

Figure 8:
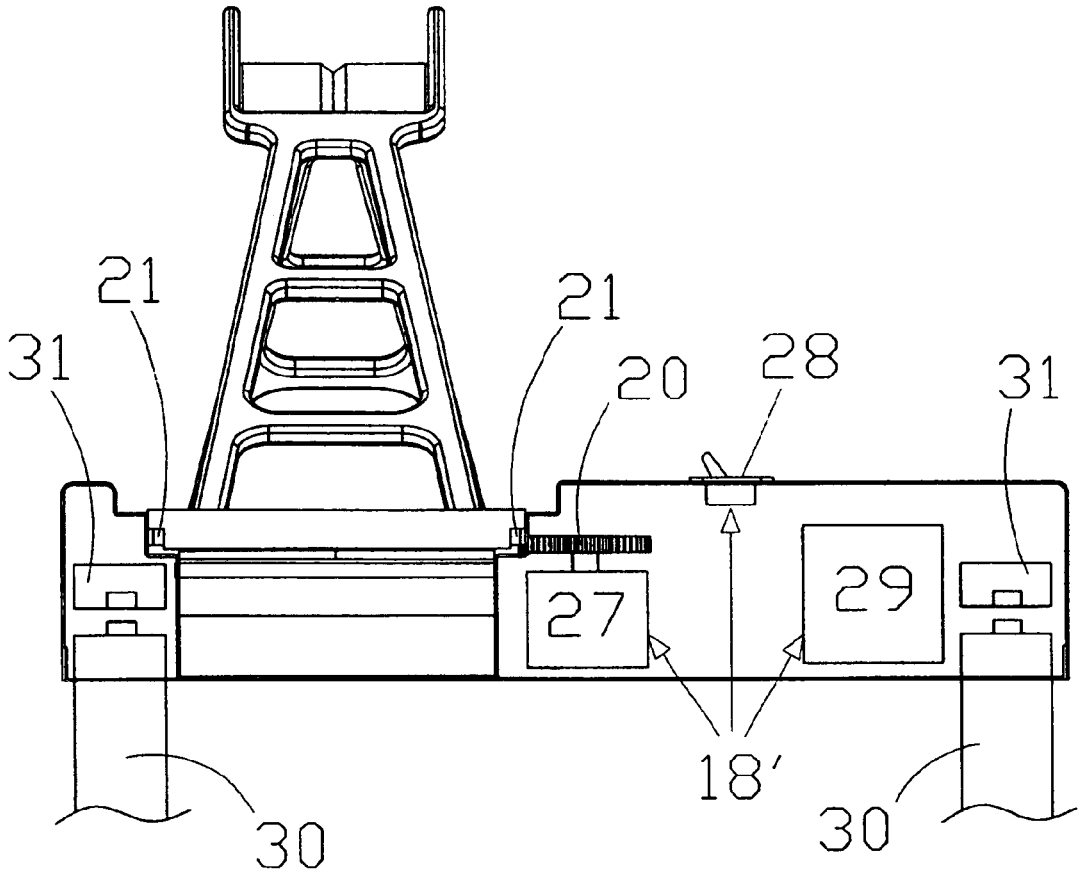
FIG. 8 is a sectional view as in FIG. 4 of another embodiment of the invention.

Referring now to FIG. 8, another embodiment 18' of the invention is shown in which the hand wheel has been replaced with an electric motor 27 driven by battery 29 through control switch 28.

While I have shown and described the preferred embodiments of my invention, it will be understood that the invention may be embodied otherwise than as herein specifically illustrated or described, and that certain changes in form and arrangement of parts and the specific manner of practicing the invention may be made within the underlying idea or principles of the invention.

What is claimed is:

1. A rifle support apparatus for a rifle, the apparatus comprising:

a) a case having a long axis;

b) an elongate recess in the upper surface of the case extending along the long axis, the recess having two long sides, and two short sides;

c) a first panel having a first end hingedly attached to one of the short sides of the recess;

d) a second panel having a first end hingedly attached to a second end of the first panel;

e) a third panel having a first end hingedly attached to a second end of the second panel, the third panel mounted within the recess for sliding translatory motion along the long sides toward and away from the first end of the first panel;

f) a rifle rest mounted at the junction of the second end of the first panel and the first end of the second panel, the rest constructed to move up and down with the junction as the third panel moves toward and away from the first end of the first panel; and g) a motion control means connected to the third panel for translatory motion of the third panel.

2. The apparatus according to claim 1 in which the motion control means includes a worm gear.

3. The apparatus according to claim 2 in which the motion control means includes a hand wheel connected to the worm gear, a rack on the third panel and a pinion gear interconnecting the rack and the worm gear.

4. The apparatus according to claim 1 in which the motion control means includes a worm gear, a rack on the third panel and a pinion gear interconnecting the rack and the worm gear.

5. The apparatus according to claim 1 in which the motion control means includes a motor driving a worm gear, a rack on the third panel and a pinion gear interconnecting the rack and the worm gear.

6. The apparatus according to claim 1 further comprising four legs storable within the case and sockets in the case for receiving the legs.

7. The apparatus according to claim 6 fiber comprising a height-adjustable rifle stock rest storable within the case for use while sighting the rifle.

8. The apparatus according to claim 1 further comprising a height-adjustable rifle stock rest storable within the case for use while sighting the rifle.

9. The apparatus according to claim 5 further comprising a second rack on an opposed side of the third panel for converting the apparatus for shooters of opposite handedness.

10. A support apparatus for a rifle, the apparatus comprising:

a) a case having a long axis;

b) an elongate recess in the upper surface of the case extending along the long axis, the recess having two long sides, and two short sides;

c) a first panel having a first end hingedly attached to one of the short sides of the recess;

d) a second panel having a first end hingedly attached to a second end of the first panel;

e) a third panel having a first end hingedly attached to a second end of the second panel, the third panel mounted within the recess for sliding translatory motion along the long sides toward and away from the first end of the first panel;

f) a rifle rest mounted at the junction of the second end of the first panel and the first end of the second panel, the rest constructed to move up and down with the junction as the third panel moves toward and away from the first end of the first panel;

g) an elongate rack affixed to a side of the third panel;

h) a motion control means including a worm gear operatively connected to the rack for controlled translatory motion of the third panel; and i) means for manually releasing the motion control means from the connection to the rack for rapid manual motion of the third panel.

11. The apparatus according to claim 10 in which the motion control means includes a hand wheel connected to the worm gear, and a pinion gear interconnecting the rack and the worm gear.

12. The apparatus according to claim 10 in which the motion control means includes an electric motor.

* * * * *